US008387900B2

(12) United States Patent
Reynolds et al.

(10) Patent No.: US 8,387,900 B2
(45) Date of Patent: Mar. 5, 2013

(54) DIRECTLY-ACTUATED PIEZOELECTRIC FUEL INJECTOR WITH VARIABLE FLOW CONTROL

(75) Inventors: Paul Reynolds, Mountain View, CA (US); Robert Andrew Banks, Mountain View, CA (US)

(73) Assignee: Weidlinger Associates, Inc., Mountain View, CA (US)

( * ) Notice: Subject to any disclaimer, the term of this patent is extended or adjusted under 35 U.S.C. 154(b) by 0 days.

(21) Appl. No.: 13/168,876

(22) Filed: Jun. 24, 2011

(65) Prior Publication Data

US 2012/0000990 A1 Jan. 5, 2012

(51) Int. Cl.

| | |
|---|---|
| ***B05B 1/30*** | (2006.01) |
| ***B05B 1/08*** | (2006.01) |
| ***B05B 3/04*** | (2006.01) |
| ***F02M 51/00*** | (2006.01) |

(52) U.S. Cl. ..... 239/585.4; 239/102.1; 239/102.2; 239/584; 239/585.1; 239/585.5

(58) Field of Classification Search ..... 239/102.1, 239/102.2, 583, 584, 585.1, 585.2, 585.3, 239/585.4, 585.5

See application file for complete search history.

(56) References Cited

U.S. PATENT DOCUMENTS

| | | | | |
|---|---|---|---|---|
| 4,101,076 | A * | 7/1978 | Bart | 239/584 |
| 4,803,393 | A * | 2/1989 | Takahashi | 310/328 |
| 5,094,480 | A * | 3/1992 | Boileau | 285/14 |
| 5,482,213 | A * | 1/1996 | Matsusaka et al. | 239/584 |
| 6,311,950 | B1 * | 11/2001 | Kappel et al. | 251/129.06 |
| 6,405,942 | B1 * | 6/2002 | Ruehle et al. | 239/102.2 |
| 6,422,482 | B1 * | 7/2002 | Stier et al. | 239/102.2 |
| 6,517,014 | B1 * | 2/2003 | Ruehle et al. | 239/585.1 |
| 6,585,171 | B1 | 7/2003 | Boecking | |
| 6,637,677 | B1 * | 10/2003 | Ruehle et al. | 239/584 |
| 6,811,093 | B2 * | 11/2004 | Rado | 239/102.2 |
| 6,834,812 | B2 | 12/2004 | Neretti | |
| 6,840,459 | B1 * | 1/2005 | Ruehle et al. | 239/102.2 |
| 6,978,770 | B2 | 12/2005 | Rauznitz | |
| 7,140,353 | B1 | 11/2006 | Rauznitz | |
| 7,309,032 | B2 * | 12/2007 | Fischer et al. | 239/585.1 |
| 7,406,951 | B2 | 8/2008 | Stoecklein | |
| 7,455,244 | B2 | 11/2008 | Boecking | |
| 7,786,652 | B2 | 8/2010 | Nakamura | |
| 7,861,943 | B2 * | 1/2011 | Feriani et al. | 239/102.1 |
| 2003/0034899 | A1 * | 2/2003 | Zisk, Jr. | 340/853.1 |

OTHER PUBLICATIONS

Bruno, Huber, Laesecke, Lemmon, & Perkins, Thermochemical and Thermophysical Properties of JP-10, technical report, Oct. 2005, 1-67, National Institute of Standards and Technology, Boulder, CO.

* cited by examiner

*Primary Examiner* — Ryan Reis

(74) *Attorney, Agent, or Firm* — Murray Tech Law; Kenneth A. Murray; Jay S. Jongjitirat

(57) ABSTRACT

A fuel injector apparatus comprising a piezoelectric driving stack and injector assembly wherein a flow control member of the fuel injector apparatus is driven directly by the piezoelectric stack without additional amplification means or interposing elements while the flow area of the nozzle portion is variably adjustable to deliver controlled flow rates in a desired flow profile to improve engine performance and reduce emissions. The injector configuration is adapted to support required flow rates with minimal linear movement of the flow control member.

20 Claims, 4 Drawing Sheets

DIRECTLY-ACTUATED PIEZOELECTRIC FUEL INJECTOR WITH VARIABLE FLOW CONTROL

STATEMENT REGARDING FEDERALLY SPONSORED RESEARCH OR DEVELOPMENT

This invention was made with government support under U.S. Navy Contract Number N00014-08-C-0546 awarded by the Office of Naval Research. The government has certain rights in the invention.

CROSS REFERENCE TO RELATED APPLICATIONS

None.

FIELD OF THE INVENTION

The present invention relates to fuel injection devices. More particularly, the present invention is related to fuel injection devices directly actuated by a piezoelectric actuator.

BACKGROUND

A fuel injector is a device for actively injecting fuel into an internal combustion engine by directly forcing the fuel into the combustion chamber at an appropriate point in the combustion cycle. For piston engines, the fuel injector is an alternative to a carburetor, in which a fuel-air mixture is drawn into the combustion chamber by the downward stroke of the piston. Current fuel injectors suffer from an inability to operate at high frequencies, which limits their applicability to advanced and emerging engine designs. In addition, current injectors cannot vary the fuel delivery profile for each injection/combustion cycle, which further limits their inclusion in more sophisticated combustion configurations, particularly those operating at higher frequencies. Furthermore, current injector configurations have a response lag associated with various factors, including a stroke amplification requirement, which impedes higher frequency operation. Finally, injectors which rely on piezoelectric actuators cannot directly actuate the flow control member that allows fuel to pass through an injection orifice into a combustion chamber due to an inability to move the flow control member a sufficient distance off seat to allow sufficient fuel to flow at a desired rate. For purposes described herein, "direct" actuation is defined as the direct physical interaction of the prime actuating device with the primary flow control member which, when moved by the prime actuating device, immediately causes fuel to flow into the combustion chamber, typically through a nozzle portion. "Direct actuation" is defined herein as having a one-to-one relationship between the actuating device and the flow control member with no additional interposing elements, amplification steps, flow channels, control pressures or other such ancillary elements necessary to operate the flow control member.

Current piezoelectric stack actuator systems used in fuel injectors do not rely on direct actuation of the nozzle assembly—in particular, that portion of the nozzle that allows fuel to flow. Instead, the piezoelectric stack is typically used to simply open and close a separate valve which varies hydraulic pressure to assist in opening the nozzle. As a result, this multi-step process of indirect hydraulic actuation and amplification creates an inherent limit to the operational frequency of the injector due to the intrinsic response lag. Consequently, these dual stage piezoelectric injectors cannot support the higher frequency operations of advanced and emerging engine technologies.

In typical fuel injectors, a nozzle assembly portion is located adjacent the combustion chamber of the engine. The nozzle includes a pin, considered the primary flow control member, and an orifice through which fuel flows into the combustion chamber. When the pin seats on a sealing portion of the orifice, fuel flow is cut off. When the pin is unseated from the sealing portion of the orifice, fuel flow is enabled.

In existing injector configurations, hydraulic amplification is used to open and close the nozzle. High pressure fuel is delivered to the entire nozzle compartment. The shape of the pin results in over-balanced pressure, causing the pin to be seated on the orifice in a closed position. An upstream actuator opens a pressure relief valve associated with the fuel delivery system, reducing pressure on one side of the pin; this results in a directional net linear force and causes the pin to lift off its seat and the nozzle to open. By closing the relief valve, pressure returns to its original level and the pin reseats to close the nozzle.

When a piezoelectric stack is used in this manner, the overall system is mechanically and operationally complex. Amplification is required due to the limited displacement of the piezoelectric stack; however, amplification requires more intricate flow arrangements within the body of the injector, additional valves, and sealing elements. More importantly, hydraulic amplification introduces significant response lag due to the two-step actuation process. This unavoidable response lag prevents a hydraulically amplified injector, even those using piezoelectric actuators, from operating at higher frequencies, such as those that might be required for pulse detonation engines.

Present injector actuation methods have other inherent limitations. For example, such injectors can only operate in a binary fashion; i.e., either fully open or fully closed. It would be preferable to provide essentially analog control of the entire fuel injection profile over each injection/combustion cycle. Attempts have been made to obtain such analog control by simply opening and closing the injector valve frequently and at differing durations in each injection cycle. Unfortunately, this approach creates an even higher operational demand due to the multiplication of actuation cycles during each injection cycle.

Two primary technologies used as "actuating" means, electromagnetic actuators and piezoelectric actuators, have inherent strengths and weaknesses. First, electromagnetic actuators (also known as solenoids) can supply sufficient linear stroke (displacement) of an injector pin to support desired maximum fuel flow, but can operate only in two modes: fully open and fully closed. A solenoid valve is an electromechanical valve incorporating an electromagnetic solenoid actuator. The valve is controlled by an electric current through a solenoid. In some solenoid valves, the solenoid acts directly on the main valve. Others use a small, complete solenoid valve, known as a pilot, to actuate a larger valve. Piloted valves require much less power to control, but are noticeably slower. Piloted solenoids usually require full power at all times to open and remain open, whereas a direct acting solenoid may only require full power for a short period of time to open, and only low power to hold in a closed position. Irrespective of the type of solenoid used, the actuator will still suffer from significant response lag, which is exacerbated as operational frequencies increase. And, again, the solenoid actuated injector is only able to operate in two states: fully open and fully closed.

The second actuator type, using a piezoelectric device, can provide faster response than a solenoid actuator, but has miniscule stroke length. Generally, a standard piezoelectric stack provides maximum displacement of $1/10^{th}$ of 1% of its height; stacks with single crystal piezoelectric material can provide displacement up to 1% of their height. Consequently, heretofore, this limited stroke length has forced piezoelectric actuation mechanisms in fuel injectors to be used in an amplification configuration. Necessarily, prior injector configurations relying on amplification have been unable to deliver direct actuation.

Various attempts have been made to increase or amplify the displacement of piezoelectric actuators. For example, one design includes a geometrically-constrained piezoelectric actuator device that amplifies displacement along an opposing axis using a diamond-shaped enclosure. As the piezoelectric element contracts or expands in a horizontal direction, the external diamond-shaped enclosure also changes shape, causing the vertical vertices of the enclosure to move a slightly greater distance than the horizontal vertices, which are controlled by the piezoelectric element. Unfortunately, the inclusion of this mechanical feature introduces the limitation of a mechanical spring variable that limits high frequency operation of the actuator and longevity. Additionally, this flextensional tensional approach used to increase displacement also results in a decrease in the maximum force applied, which is another increasing displacement by only a very small amount and would still require amplification if used as an actuator in a fuel injector.

Information relevant to other attempts to address these problems can be found in U.S. Pat. Nos. 7,786,652; 7,455,244; 7,406,951; 7,140,353; 6,978,770; 6,834,812; 6,585,171; and 4,803,393. However, each one of these references suffers from one or more of the following disadvantages which will tend to impede high frequency operation and the optimization of each combustion cycle to create maximum efficiency: indirect actuation, partial spring actuation; complex mechanisms with a plurality of components and parts; operation only in a fully open or fully closed position; stroke distances which would require prohibitively long piezoelectric stacks; multiple boosters required to achieve necessary forces; actuating mechanisms that are unable to accommodate sufficient stroke; the inclusion of spring elements likely to induce valve float at higher frequency operation; indirect actuation via hydraulic amplification resulting in lag and hysteresis; no analog control of valve position; and inability to provide refined prestress on the piezoelectric stack to avoid placing it in tension or adapting to differing operating parameters. Additionally, it is evident that these other attempts fail to provide an injector having a one-to-one relationship between the prime actuating force and the flow control member without interposing elements. Consequently, these other attempts do not provide direct actuation.

For example, Nakamura et al., U.S. Pat. No. 7,786,652 B2 issued Aug. 31, 2010, describes an injection apparatus using a multi-layered piezoelectric element stack. The invention disclosed by Nakamura et al. is directed to a need for a multi-layer piezoelectric element that can be operated continuously with a high electric charge without peel-off or cracking between the external electrode and the piezoelectric layer, which can lead to contact failure and device shutdown. The injector apparatus described by Nakamura et al. uses a needle valve which is sized to plug an injection hole to shut off fuel. The injector apparatus includes a spring underneath a piston valve member so that when power is removed from a piezoelectric actuator, the spring actually causes the valve to open and allow fuel injection. The stack only acts to close the valve. Furthermore, Nakamura et al. does not describe a method for prestressing the piezoelectric stack. General operation of the injector is either fully open or fully closed, with no ability to provide variable injection rates. The fuel flow rate is controlled by an orifice and is not adjustable. Additionally, it is unclear how the piezoelectric stack described by Nakamura et al. would provide sufficient stroke or contraction to move the needle sufficiently to unplug the injection hole, even with the inclusion of a supplementary spring. For the operational requirements associated with pulse detonation engines, the injector described by Nakamura et al. would neither enable sufficient flow nor operate at a sufficiently high frequency. Thus, the injector described by Nakamura does not have a one-to-one relationship between the prime actuating force and the flow control member without interposing elements and is therefore not directly actuated.

Further, Boecking, U.S. Pat. No. 7,455,244 B2 issued Nov. 25, 2008, describes a piezoelectric fuel injector for injecting fuel into a combustion chamber of an internal combustion engine, wherein the injector includes a first and second booster piston, and the first booster piston is actuated using a piezoelectric stack to actuate the second booster piston which then moves a pin off seat to open the injection opening. The injector described by Boecking is directed to a need for a fuel injector of especially compact structure. Multiple springs within the injector body are used to generate closing forces. The system described by Boecking is a complex mechanism with minimal stroke displacement to move the pin sufficiently to support high volume fuel delivery. Due to the inclusion of spring-loaded elements, the described injector will suffer float at higher frequency operation. Additionally, Boecking's injector relies on the movement of a small needle valve, which will inhibit the ability to deliver flow at higher rates. Further, Boecking's injector does not have a one-to-one relationship between the prime actuating force and the flow control member without interposing elements and is therefore not directly actuated.

Stoecklein, U.S. Pat. No. 7,406,951 issued Aug. 5, 2008, describes a piezoelectric fuel injector for injecting fuel into an internal combustion engine wherein the fuel injector has an injection valve member that is indirectly actuated by a piezoelectric actuator. Stoecklein suggests that the injection valve member is "directly" actuated by the piezoelectric stack, but the description confirms that hydraulic amplification is used between the actuator and the injection valve. Hence, as defined herein, the injector of Stoecklein is not directly actuated. Additionally, the valve member relies on a spring element to move into a closed position. Stoecklein's invention also attempts to solve the problem in prior piezoelectric fuel injectors whereby intermediate positions of the valve between fully open and fully closed are unstable and cannot be maintained. Stoecklein describes a solution involving multistage hydraulic boosting of the actuator stroke to achieve stable intermediate stop positions. To overcome system pressure and open the valve member, an initial force is applied by reducing the current supply to the piezoelectric actuator. The shrinking length causes a pressure decrease in a hydraulic coupling chamber and, in turn, the control chamber. After a critical pressure has been reached, the valve opens to an intermediate stroke position. In order to achieve a complete opening of the valve member, the boosting is changed once the piezoelectric actuator has traveled a certain amount of its stroke distance. However, Stoecklein's approach does not address issues of response lag nor adaptation to operate at high frequencies. Furthermore, although limited two-stage control is described, highly granular, essentially analog control is not supported by Stoecklein's injector system. As with the prior referenced designs, the injector includes springs which can cause valve float at higher operational frequencies. Stoecklein also confirms that a stroke of several hundred micrometers would be required to deliver desired flow rates, whereas the stroke available from reasonably sized stacks is on the order of 20 to 40 microns. Additionally, the injector of Stoecklein must rely on a two-stage boost to achieve sufficient opening. As in the other referenced designs, Stoecklein's injector also does not have a one-to-one relationship between prime actuating force and the flow control member without interposing elements and is therefore not directly actuated.

Rauznitz et al., U.S. Pat. No. 7,140,353 B1 issued Nov. 28, 2006, describes a piezoelectric injector containing a nozzle valve element, a control volume, and an injection control valve for controlling fuel flow wherein a preload chamber is used to apply a preload force to the piezoelectric stack elements. Rauznitz et al. emphasizes the necessity of the hydraulic preload to adequately prestress the piezoelectric stack to ensure reliable operation. However, as described, the injector of Rauznitz et al. only operates in fully closed and fully open positions. Hence, even though the injector may improve firing for opening and closing to address flow profile, it fails to provide analog control of the valve position to deliver highly granular control of the flow profile throughout each combustion/injection cycle. Additionally, opening and closing of the valve requires amplification with actuation of multiple components. Thus, the injector of Rauznitz et al. fails to provide direct actuation of the valve control member, limiting application in high frequency injection scenarios, and, fails to provide highly granular control of the fuel flow profile, limiting use, for example, in pulse detonation engines. Finally, the injector is designed to accommodate only smaller injector needles and would not support large injector sizes to accommodate increased fuel flow. Thus, this Rauznitz et al. injector does not have a one-to-one relationship between the prime actuating force and the flow control member without interposing elements and is therefore not directly actuated.

Rauznitz et al., U.S. Pat. No. 6,978,770 B2 issued Dec. 27, 2005, describes a piezoelectric fuel injection system and method of control wherein the fuel injector contains a piezoelectric element, a power source for activating the element to actuate the injector, and a controller for charging the piezoelectric element directed to control of the injection rate shape. The system disclosed by Rauznitz et al. delivers closed, intermediate and fully open control. These three positions are further supported by rapid opening and closing of a nozzle valve element to create an improved rate shape; however, precise control and analog positioning of the nozzle valve needle throughout its stroke length is not possible. Furthermore, the injector uses springs to bias the valve element into a closed position, which introduces complexity and will cause the injector to suffer float at higher frequency operation. Thus, this Rauznitz et al. injector does not have a one-to-one relationship between the prime actuating force and the flow control member without interposing elements and is therefore not directly actuated.

Neretti et al., U.S. Pat. No. 6,834,812 B2 issued Dec. 28, 2004, describes a piezoelectric fuel injector directed to providing inward displacement of the valve to avoid external soilage. The valve is contained within an injection pipe and is moveable along its axis between a closed and an open position by expansion of the piezoelectric actuator. There are only two valve positions—fully open and fully closed—without the ability for analog or variable injection. A mechanical transmission is placed between the piezoelectric actuator and the valve in order to invert the displacement produced by expansion of the piezoelectric actuator and displace the valve in an inward direction. This mechanism adds complexity to the injector assembly. Thus, the injector of Neretti et al. does not have a one-to-one relationship between prime actuating force and the flow control member without interposing elements and is therefore not directly actuated.

Boecking, U.S. Pat. No. 6,585,171 B1 issued Jul. 1, 2003, describes a fuel injector system comprising a fuel return, high pressure port, piezoelectric actuator stack, hydraulic amplifier, valve, nozzle needle, and injection orifice. The piezoelectric stack of the Boecking injector does not directly actuate the nozzle needle. Close examination reveals that the piezoelectric stack instead actuates a separate hydraulic amplifier to open the valve, which allows the nozzle needle to move off the injection orifice. The needle of the Boecking injector is not directly actuated by the piezoelectric stack. Furthermore, the Boecking injector is limited to operation in two discrete modes: on and off. Hence, Boecking's injector does not have a one-to-one relationship between prime actuating force and the flow control member without interposing elements and is therefore not directly actuated.

Takahashi, U.S. Pat. No. 4,803,393 issued Feb. 7, 1989, describes a piezoelectric actuator for moving an object member wherein the actuator includes a piezoelectric element, an envelope having a bellows, and a pressure chamber where work oil is hermetically enclosed. The invention disclosed by Takahashi is directed to the need for an improved piezoelectric actuator that can prevent the breakdown of the piezoelectric element due to slanting attachments and defective sliding. This is achieved by an envelope between the piezoelectric element and the valve or object member, the envelope containing a resilient member and hermetically containing a fluid. The inclusion of the envelope and spring mechanisms in the injector of Takahashi introduces the problem of valve float at higher operational frequencies, along with indirect actuation limitations. Additionally, the piezoelectric actuator of Takahashi is not used to directly actuate the needle which controls flow but, instead, is used to move a separate upstream control valve which then allows flow to be delivered to the injector assembly. Hence, Takahashi's injector does not have a one-to-one relationship between prime actuating force and the flow control member without interposing elements and is therefore not directly actuated.

Consequently, there exists a need for a fuel injector having the rapid response afforded by direct actuation of an injector nozzle pin (flow control member) by a piezoelectric stack without interposing elements between the prime actuating force and the flow control member. There is also a need for such an injector able to provide dynamic, controlled variable flow throughout an entire combustion/injection cycle, avoiding limitations to flow rate resulting from simplistic on/off operation and selection of orifice size. There is a further need for a fuel injector able to accommodate higher frequency cycling and higher pressure operating conditions. There is also a need for a high frequency injector having minimal latency and response lag. There is an additional need for a high frequency injector able to accommodate relatively high flow rates. There is also a need for an injector that does not require boost or amplification of the actuator mechanism to meet operational requirements.

SUMMARY

In view of the foregoing described needs, an aspect of the present invention includes a directly actuated piezoelectric fuel injection system having no interposing elements between the actuating mechanism, the piezoelectric stack, and the flow control member. This configuration significantly increases control which directly improves fuel economy and reduces emissions in a plurality of engine systems. The present invention comprises a directly actuated piezoelectric fuel injector apparatus that satisfies the above needs for a simplistic mechanism, rapid control response, minimal response lag, high frequency operation, the ability to accommodate high flow rates, high fuel supply and fuel injection pressures, and the capability to deliver variable control of flow throughout the combustion/injection cycle.

An embodiment of the present invention includes a directly actuated fuel injector apparatus comprising a piezoelectric driving stack and a flow nozzle assembly wherein a flow control member of the fuel injector apparatus is driven directly by the piezoelectric stack without interposing elements including additional amplification means while the flow area of the nozzle portion is variably adjustable to deliver controlled flow rates in a desired flow profile. The injector is adapted to support required flow rates with minimal linear movement of the flow control member portion of the nozzle away from a seating portion of the nozzle. Thus, the injector is able to accommodate the displacement limitations of piezoelectric actuating mechanisms.

Another embodiment of the fuel injector assembly according to the present invention comprises a cylindrical housing, a flow control member, a piezoelectric driving stack, and a flow nozzle portion wherein the flow control member is directly controlled by the piezoelectric stack without additional amplification means or interposing elements. The piezoelectric stack is controlled via drive electronics comprising a power amplifier, filters, and a processor providing custom design of a driving waveform; and a user interface providing user control of said waveform in real time. The current and voltage delivered to the stack which establishes the amount of expansion or contraction from a prestressed state is controlled by these drive electronics.

The flow control member and nozzle portion are configured to provide a variably adjustable flow area to deliver controlled flow rates in a desired flow profile despite miniscule movement of the flow control member by the piezoelectric stack. The injector is uniquely adapted to support required flow rates with minimal linear movement of the flow control member away from a sealing seat of the nozzle. The actuating piezoelectric stack is placed in a pre-stressed state to ensure the piezoelectric stack is continually in compression during operation. In one aspect, the pre-stress is delivered by screwing the housing end cap down on top of the stack, thereby applying an initial downward force on the top of the piezoelectric stack. The initial downward force can be adjusted by tightening or loosening the end cap. The flow control member is unseated by a reduction in the piezoelectric stack driving force which, in combination with the contraction of the piezoelectric stack, allows the existing fuel pressure to assist to move the flow control member away from the seat of the nozzle, thus allowing fuel to flow into the combustion chamber at a prescribed rate as determined by fuel type, pressures and available flow area.

BRIEF DESCRIPTION OF THE DRAWINGS

These and other features, aspects and advantages of the present invention will become better understood with regard to the following description, appended claims, and accompanying drawings where:

FIGS. 3A and 3B show an enlarged view of the cross-section of FIG. 3, wherein FIG. 3A shows the fuel injector in a closed state and FIG. 3B shows the fuel injector in an open state;

OBJECTIVES OF THE INVENTION

A first objective of the present invention is to provide a fuel injector capable of providing much greater control over fuel flow rate throughout the combustion cycle, thereby significantly improving fuel efficiency and substantially reducing the emission of harmful air pollutants.

Another objective of the present invention is to provide rapid fuel injector response to support high frequency operation along with highly granular control of fuel flow rate during each injection cycle.

Another objective of the present invention is to provide a fuel injector having the ability to operate at extremely high frequencies to support improved performance in advanced and emerging engine designs.

Another objective of the present invention is to provide a fuel injector with the ability to vary the fuel delivery profile for each injection/combustion cycle, which further enhances desirability for inclusion in more sophisticated combustion configurations, particularly those operating at higher frequencies.

Another objective of the present invention is to provide a fuel injector having minimal control signal response lag further supporting use and operation at higher frequencies.

Another objective of the present invention is to create a fuel injection device that is operated electronically rather than mechanically, eliminating the need for the plethora of mechanical components found in current engine configurations such as rotary valves, rocker arms, poppet valves, push rods, valve springs, cam shafts, oil pumps, and other ancillary equipment necessary to support mechanically-driven engine valve assemblies.

Another objective of the present invention is to provide an operable fuel injector using minimal linear movement of the actuating mechanism.

Another objective of the present invention is to provide an injector with a minimal number of moving parts to increase operational longevity.

Another objective of the present invention is to provide an injector where the actuator displacement is sized to avoid the inclusion of a sliding seal, thereby supporting the use of an elastomeric seal which wobbles rather than slides within the chamber of the injector.

Another objective of the present invention is to provide an injector wherein the back pressure on the nozzle and flow control member of the injector can be adjusted via changes to a downstream flow orifice.

Another objective of the present invention is to provide an injector wherein the flow control member and nozzle shapes may be readily adjusted to deliver different flow profiles while still using the equivalent piezoelectric actuating mechanism.

DESCRIPTION

Figure 2:
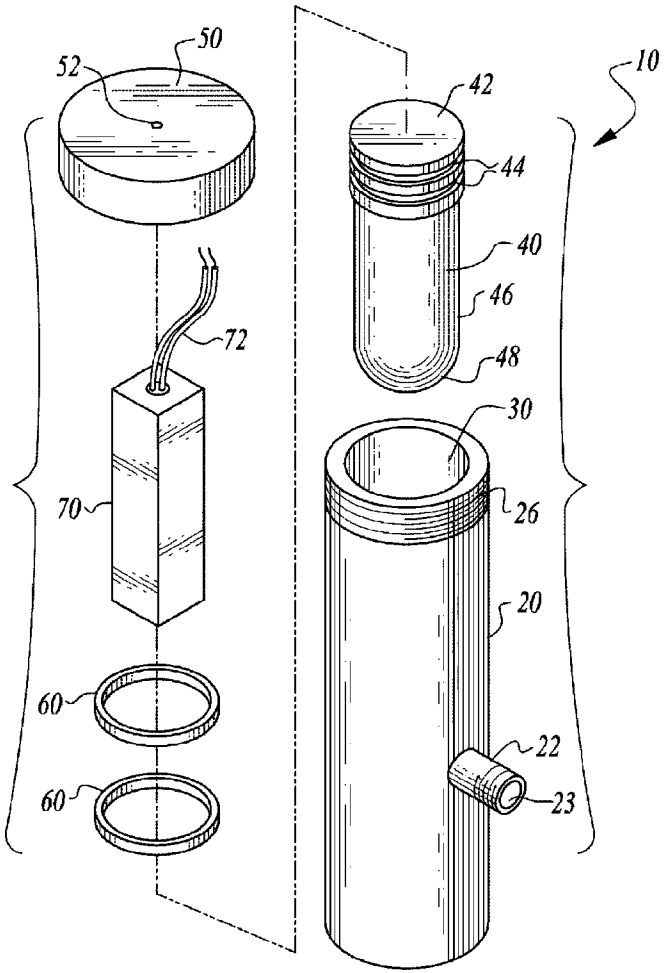
FIG. 2 shows an exploded view thereof.
Figure 1:
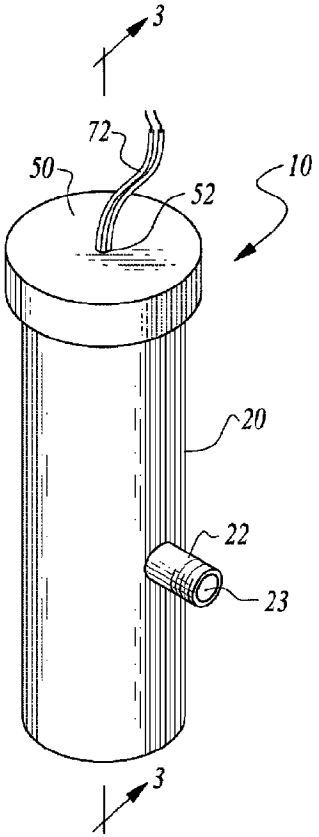
FIG. 1 shows a perspective view of a fuel injector according to a first embodiment of the present invention.

The following description is merely exemplary in nature and is in no way intended to limit the invention, its application, or its uses. As illustrated in FIG. 1, a fuel injector assembly 10, according to a first embodiment of the present invention, includes a cylindrical housing 20 having a circular end cap 50. As illustrated in FIG. 2, an exploded view of the injector assembly 10 is shown including the housing 20 having an inner cylindrical chamber 30 for slidably receiving an injector flow control member 40. Circular seals 60 enclose an upper grooved portion of the control member 40. As shown, the seals 60 are rings to conform to the geometric profile of the flow control member 40 and chamber 30. The seals 60 provide a pressure seal between chamber 80 through which pressurized fuel flows and chamber 90 which encapsulates the piezoelectric stack 70. One skilled in the art would recognize that only one seal could be used, or a plurality of seals could be used, as required by pressure containment requirements. Additionally, various seal configurations could be further supported by the inclusion of other sealing material or fluids within the chamber 90 of the injector 10. Such fluid-based sealing options would likely include a pressure compensation bladder to allow movement of the flow control member 40. Such fluid-based sealing options would also provide additional means for insulating the piezoelectric stack 70 by including a non-conductive fluid. The fluid-based system could also provide a means for providing thermal control to the stack via insulating properties or heat transfer properties. Further, the sealing means could have different geometric shapes, such as chevron or other geometric seals used in hydraulic applications. Still further, the seals can be made of different materials capable of separating the pressured fuel delivered via chamber 80 from the chamber 90 encapsulating the piezoelectric stack 70, such as rubber, nylon, ceramic, and other such materials. Other seal types could be used to ensure a pressure seal within the housing 20 without departing from the spirit and scope of the various embodiments and aspects of the present invention. A piezoelectric stack 70 for controlling the position of the control member 40 within the cylindrical chamber 30 is interposed between the flow control member 40 and the end cap 50.

Figure 5A:
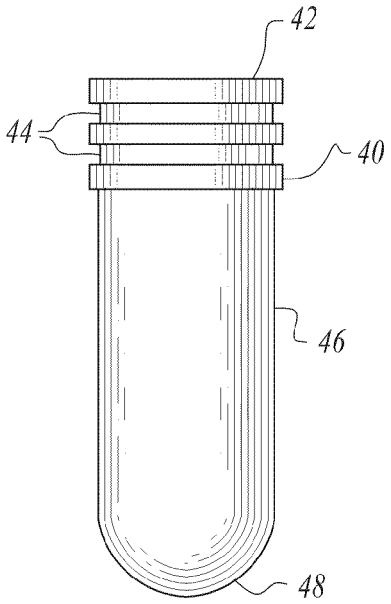
FIG. 5A shows a side elevation view of the flow control member of the fuel injector assembly shown in FIG. 2.
Figure 5B:
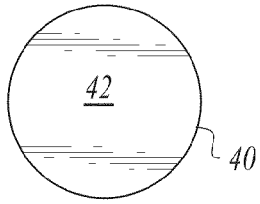
FIG. 5B shows a top plan view thereof.
Figure 5C:
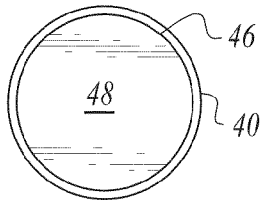
FIG. 5C shows a bottom plan view thereof.
Figure 6A:
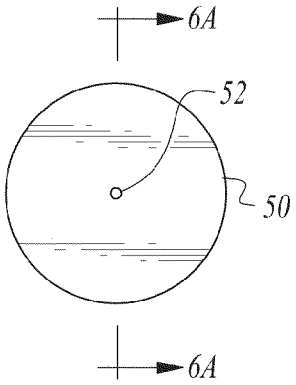
FIG. 6A shows a top plan view of the end cap of the fuel injector assembly shown in FIG. 2.
Figure 6B:
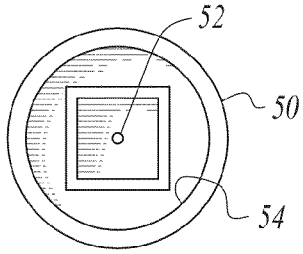
FIG. 6B shows a bottom plan view thereof.
Figure 6C:
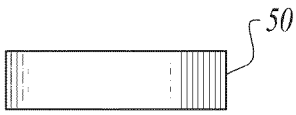
FIG. 6C shows a side elevation view thereof.
Figure 6D:
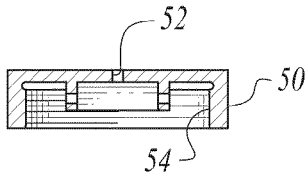
FIG. 6D shows a cross-section view thereof.

The housing 20 includes a body 21 with a fuel inlet nozzle 22 penetrated by a fuel flow passage 23 for receiving pressured fuel from an external fuel source (not shown). The injector housing 20 includes a bottom 24, and a top 26 for attachment of the end cap 50 to the housing 20. As shown in FIG. 2 and in further detail in FIGS. 5A-5C, the flow control member 40 includes a circular top 42 above cylindrical seal grooves 44, and a lower cylindrical body portion 46 having a hemispherical nose portion 48 with a first radius of curvature C1. The piezoelectric stack 70 includes conductors 72 for delivering electrical power to operate the piezoelectric stack 70. As shown in FIG. 6A, the end cap 50 includes a penetration 52 through which the conductors 72 exit the inner cylindrical chamber 30 of the housing 20 to connect to a separate control system (not shown) which powers the stack 70 to expand and contract at the desired frequency and stroke displacement. The control system includes drive electronics comprising a power amplifier, power filters, and a processor providing custom design of a driving waveform; and a user interface providing user control of said waveform in real time. The current and voltage delivered to the stack 70 via conductors 72 establishes the amount of expansion or contraction of the stack 70 from a prestressed state as determined and controlled by the drive electronics.

As further illustrated in FIG. 6A-6D, a top, bottom, side, and cross-sectional view of the end cap 50 of the fuel injector 10 is shown. The end cap 50 includes an inner screw threaded portion 54 for attachment of the end cap 50 to the screw threaded portion of the top 26 of the housing 20. The end cap 50 further includes a preferably centered penetration 52 to receive and exit the conductors 72 from the housing 20.

Figure 3:
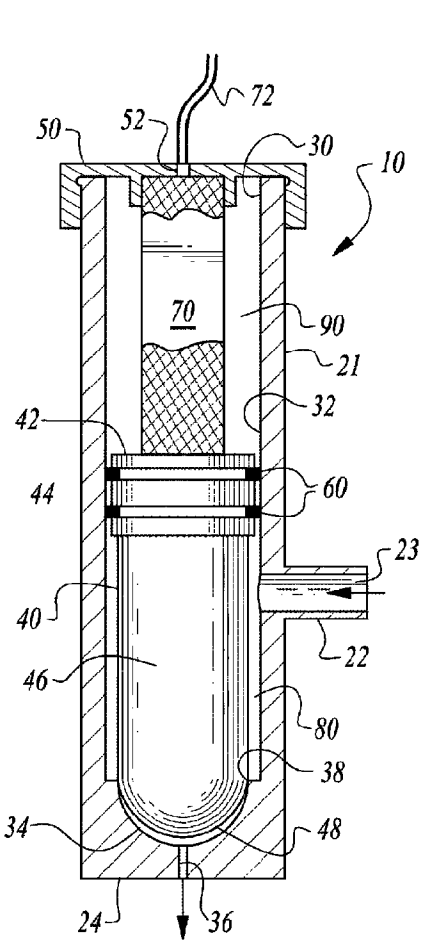
FIG. 3 shows a cross-section view of the fuel injector shown in FIG. 1, taken along the cutting plane 3-3.

Now, in even greater detail, FIG. 3 provides a cross-sectional view of the assembled injector assembly 10 shown in FIG. 1 taken along the cutting plane described by line 3-3. The housing 20 includes a body 21 with an inlet nozzle 22 having cylindrical fuel flow passage 23 for receiving pressurized fuel into a lower portion 80 of the inner cylindrical chamber 30 of the injector assembly 10. The housing 20 further includes a bottom nozzle portion 24 penetrated by an outlet nozzle 36 through which fuel is delivered to the combustion chamber of an engine. The inner cylindrical chamber 30 includes an inner wall 32. Grooves 44 of the flow control member 40 are sized to receive and seat circular seals 60 to create a seal between an upper portion 90 of the inner cylindrical chamber 30 and lower portion 80 which receives and transfers the pressurized fuel to an engine combustion chamber.

Figure 4A:
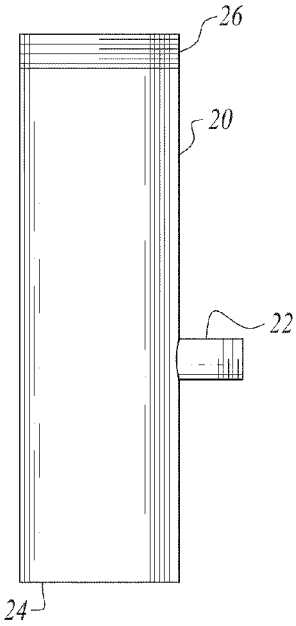
FIG. 4A shows a right side elevation view of the fuel injector housing of the injector assembly shown in FIG. 1.
Figure 4B:
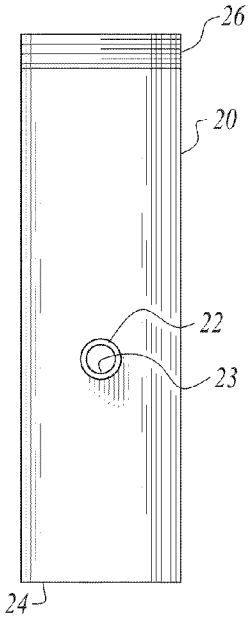
FIG. 4B shows a front side elevation view thereof.
Figure 4C:
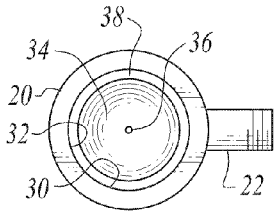
FIG. 4C shows a top plan view thereof.
Figure 4D:
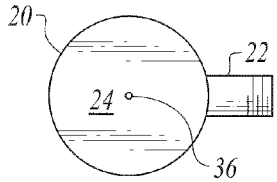
FIG. 4D shows a bottom plan view thereof.

As illustrated in FIG. 4C, a top view of the housing 20 without the end cap 50 in place is shown. The housing 20 includes an inner cylindrical chamber 30 wherein a wall 32 of the chamber is sufficiently honed and sized to slidably and snugly receive the flow control member 40. The inner cylindrical chamber 30 includes a lower nozzle surface 34 having a hemispherical shape and a second radius of curvature C2 smaller than the first radius of curvature C1 of the nose 48 of the flow control member 40. A sealing seat 38 circumscribes the top of the inner lower nozzle surface 34. An outlet nozzle 36 penetrates the inner nozzle surface 34 through the bottom nozzle portion 24 for jetting fuel into the combustion chamber of an engine.

Figure 3A:
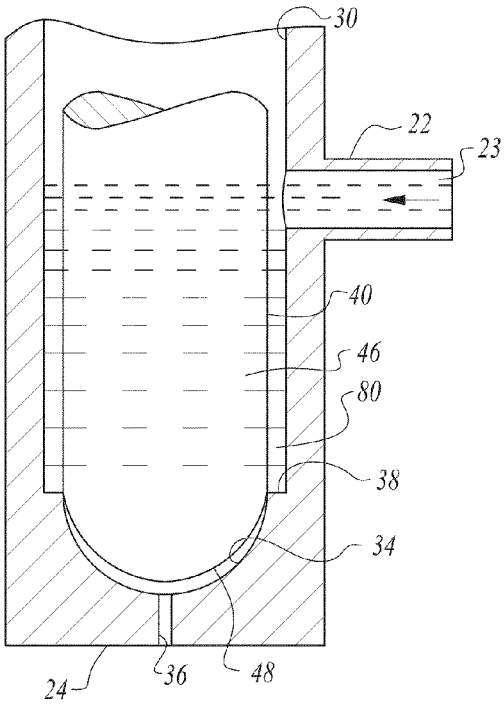
Figure 3B:
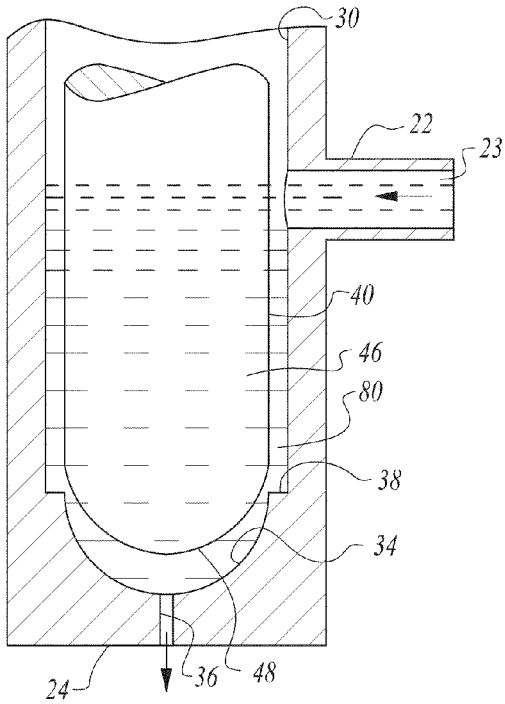

With reference to FIGS. 3A and 3B, the operation of the injector assembly 10 is shown. In a closed state, as shown in FIG. 3A, the nose 48 of the control member 40 is seated against a sealing seat 38 of the inner chamber 30. The chamber 30 includes a generally hemispherical inner nozzle surface 34 having a second radius of curvature C2 smaller than a first radius of curvature C1 of the nose 48 of the control member 40, causing the nose 48 and sealing seat 38 to create a limited sealing contact area which prevents fuel flow and lessens the force necessary to disengage the control member 40 from the sealing seat 38 during opening. In this closed state, pressurized fuel resides in the inner lower chamber 80 prescribed by the body 46 of the flow control member 40, the sealing seat 38, and the seals 60 in the upper portion 46 of the control member 40. In operation, with power removed from the stack 70, the stack 70 expands in a fail-safe mode to seat the control valve member 40 on the sealing seat 38 and interrupt fuel flow.

To reach an open state, as shown in FIG. 3B, the downward force delivered by the piezoelectric stack 70 is reduced to retract the nose 48 of the control valve member 40 away from the sealing seat 38. Once the stack 70 has retracted the control valve member 40, the force generated by the pressure of the fuel against the control valve member 40 provides a momentary additional opening force to assist in opening the injector 10. Once open, the nose 48 of the flow control member 40 is then controlled by the stack 70 to maintain a desired position in order to create a flow area appropriate to the desired flow rate. Pressurized fuel is then able to flow through the passage 23 of the inlet nozzle 22 into the chamber 80 and through the outlet nozzle 36 into a combustion chamber (not shown).

The expansion or contraction of the piezoelectric stack 70 can be controlled with sufficient granularity to allow very precise control over the movement of the flow control member 40, resulting in very precise control over the fuel flow rate. The stack 70 may be expanded or contracted multiple times during any cycle, by arbitrary magnitudes each time, thus allowing arbitrary fuel flow profiles in each cycle to be realized. Coupled with the novel geometric configuration of the injector 10 based upon the first radius of curvature C1 of the nose 48 of the valve member 40 and the second radius of curvature C2 of the inner nozzle surface 34, even more precise control of flow rate is afforded.

In operation, the present embodiment of the fuel injector assembly 10 creates a dynamic flow area which allows very precise variable control of fuel flow from the injector 10 into a combustion chamber. Precise control is afforded by direct actuation of the flow control member 40 which allows controlled variability of an annular flow area 37 to provide variable fuel delivery profiles to optimize engine performance for efficiency, distance, power, velocity, emission control, or any combination of multiple performance objectives. Integration of the fuel injector assembly 10 with other sensors, control circuitry, and operational intelligence will deliver substantially enhanced engine and vehicle control, shifting methods used for engine component actuation from primarily mechanical actuation to primarily electronic actuation means.

As previously described and illustrated in FIGS. 3A and 3B, the injector 10 allows sufficient fuel to be delivered despite significantly reduced linear displacement of the flow control member. The injector 10 leverages a first larger radius C1 of the body 46 and nose 48 of the flow control member 40 juxtaposed against a second smaller radius C2 of the inner nozzle surface 34 and the sealing seat 38. Furthermore, the diameter of the flow control member 40 and associated inner cylindrical chamber 30 is sized to allow adequate fuel flow despite minimal linear displacement of the flow control member 40. In the present embodiment, the inner nozzle surface 34 includes an outlet nozzle 36 which penetrates the bottom nozzle portion 24 of the housing 20. The outlet nozzle 36 can be sized to limit maximum fuel flow irrespective of the flow enabled by the displacement of the flow control member 40. Consequently, an engine system can be designed to constrain maximum fuel flow to a specified limit. Additionally, in an additional embodiment, the outlet nozzle 36 can be removed in its entirety such that the fuel flow is determined by the movement of the control valve member 40 and the geometric relationship between the nose 48, the sealing seat 38, and the inner nozzle surface 34.

Now, the rationale for the design and operation of the fuel injector assembly 10 is described. First, to accommodate significantly reduced displacement of the flow control member 40 from the seat 38 caused by the use of a piezoelectric stack 70 as a direct actuator of the flow control member 40, a different flow control conformation is used. Generally, the flow control member of a fuel injector, commonly known as a "pin" or "needle," has approximately the same diameter as the orifice through which fuel is jetted into the combustion chamber of an engine. The pin in a conventional injector is simply used to shut flow on and off, and hence, the orifice serves as the primary means of flow control. Consequently, there is an inability to adjust flow without changing the size of the orifice.

Following conventional injector design approaches, the pin (flow control member) would be sized to close off an orifice having a diameter of approximately 1 mm. In contrast, in the present embodiment of the invention, the flow control member 40 has a diameter of approximately 15 mm. One skilled in the art would recognize that the diameter of the flow control member 40 may be adapted to various flow requirements, and could be scaled up or down as desired.

Thus, the injector 10 of the present embodiment of the invention takes a contrary approach to conventional configurations by incorporating a significant modification to the physical size and relationship between the flow control member 40 and the displacement of the flow control member 40 made available by the piezoelectric stack 70. The stroke or displacement of the piezoelectric actuator stack 70 is typically on the order of tens of microns. Hence, to accommodate the desired flow rate, the injector 10 is sized to accommodate a much larger flow control member 40 to provide a significantly greater annular flow area 37 around the nose 48 of the flow control member 40. The available flow area is driven by the annular area 37 presented as the nose 48 of the flow control member 40 is moved away from the sealing seat 38 by the stack 70. In the present embodiment, the available flow area is determined by the smallest annular cross-section presented by the geometric difference between the nose 48 having a first radius of curvature C1 and the inner nozzle surface 34 having a second radius of curvature C2. As the stack 70 contracts to move the nose 48 of the flow control member 40 in an upward direction, the available flow area increases as a function of the geometric relationship between the nose 48 and the inner nozzle surface 34. Hence, the available flow area as a function of available stroke of the stack 70 may be adjusted by changing the shape of the nose 48, the shape of the inner nozzle surface 34, or both.

For conventional injectors having an essentially equivalent needle diameter slightly greater than 1 mm and effective orifice diameter of 1 mm, where the exposed orifice area is considered independent of the stroke length, the calculated flow area of a 1 mm diameter orifice is 0.125 sq. mm. Based upon desired flow rates, pressures and an initially selected fuel of JP-10, this flow area alone is insufficient to achieve the desired flow rates associated with the operation of a preferred pulse detonation engine. Hence, in a conventional injector, the small flow control member, i.e., the "pin" or "needle," is a "bottleneck".

When considering various size constraints and operating parameters, the height of the piezoelectric stack 70 determines the available stroke displacement S. By expanding the diameter of the flow control member 40 significantly, a desired effective flow rate can be maintained despite miniscule stroke displacement S of the stack 70.

As an example, to accommodate desired fuel flow rates for a pulse detonation engine operating on JP-10 fuel, a first embodiment of the fuel injector 10 according to the invention uses a flow control member 40 having a diameter of 15 mm. A diameter of 15 mm accommodates and reliably supports the square cross section of the actuating stack 70 having side dimensions of 10 mm×10 mm (approximately 14 mm across diagonally) with stroke S between 10 and 40 microns. This correlation between the size of the stack 70 and the diameter of the flow control member 40 is selected as a desirable design point that delivers appropriate performance in a suitable package size for inclusion in various engine applications.

As illustrated in FIG. 3, in the present embodiment of the invention, the nose 48 of the flow control member 40 has a greater radius of curvature than the inner nozzle surface 34. The flow area prescribed by the separation of the profile of the nose 48 of the flow control member 40 from the profile of the inner nozzle surface 34 varies with the stroke displacement S of the stack, thus providing highly granular, analog control of flow. Although the stack 70 displacement S provides highly resolute motion, the inclusion of differing nose 48 and inner nozzle surface 34 profiles further serves to increase the granularity of flow control of the injector 10. Although shown in one curvature, the operational flow profile of the injector 10 can be adjusted by modifying the curvature of the nose 48 and the inner nozzle surface 38, while still using the same stack 70 with the same stroke displacement S.

In the present embodiment, the injector 10 is shown as including a smaller 1 mm diameter outlet nozzle 36 in conjunction with a larger diameter flow control member 40 and nose 48. The flow control member 40 and nose 48 geometrically interact with the sealing seat 38 and the inner nozzle surface 34. Alternative embodiments of the present invention do not include the outlet nozzle 36 and flow would be controlled by the geometric interaction between the nose 48 and sealing seat 38. Other embodiments would include differently shaped inner nozzle surfaces 34 which would likewise adjust flow rate and pattern. However, in various aspects, the outlet nozzle 36 can be sized to limit flow, configured to provide a specific spray pattern or droplet size, or provide a means for attachment of the injector 10 to an engine combustion chamber. Further, in other embodiments, the outlet nozzle 36 can be modular and removable from the injector 10. Still further, the outlet nozzle 36 in a removable, modular form, could be used to serve as an additional means for adjustably or fixedly prestressing the piezoelectric stack 70 in an equivalent manner to the end cap 50, wherein an adjustable desired prestress load is delivered to the piezoelectric stack 70 via rotation of a modular outlet nozzle 36 to compress the stack 70 via the flow member 40. Additionally, although tested with a 50 bar supply line connected to the fuel inlet nozzle 22, the injector assembly 10 can be adjusted to accommodate different pressure supplies. The present embodiment of the invention accommodates piezoelectric stacks 70 having side dimensions of 10×10 mm with a stack height of 20 to 40 mm. The injector assembly 10 can be scaled up or down to accommodate differing stack sizes and flow requirements.

The end cap 50 is screwed onto the top of the housing 20 using the upper top threads 26 to seal the injector 10 and apply a prestress compression to the stack 70. Other means for adjusting the desired prestress load would be suitable including such approaches as finer threads, geared micrometers, geared stepper motors, and other such devices that could precisely control the placement of an adjustable or fixed desired prestress load on the stack 70. The injector 10 is configured to operate at high combustion operating temperatures and high pressure, as well as with volatile fuel and corrosive chemicals. In the president embodiment, stainless steel was chosen as the preferred material for mechanical and chemical robustness along with ease and practicability of machining. Other materials, including ceramic, would be suitable and adaptable for particular uses.

Referring to FIG. 3, in operation, the piezoelectric stack 70 controls the linear movement of the flow control member 40. In testing the present embodiment of the invention, a displacement stroke S of approximately 40 microns is generated using an operational voltage of 200 volts applied to the piezoelectric stack 70. In one embodiment, a piezoelectric stack 70 having a 200 layer single crystal stack 20 mm long will meet these operational parameters. In a second embodiment, a standard piezoelectric stack having an approximate height of 40 mm is used to achieve the desired stroke length S of approximately 40 microns. Essentially, for existing piezoelectric materials, the stroke available is approximately 1% of the height of the stack, assuming delivery of sufficient electrical power to the stack. The housing 20 of the injector 10 is able to accommodate both a 20 mm and 40 mm stack height where a spacer is placed between the end cap 50 and the top of the stack 70 to accommodate the 20 mm stack. A stack 70 comprised of single crystal piezoelectric material is substantially more expensive than a stack composed of standard piezoelectric materials. However, a stack 70 comprised of single crystal layers will allow the overall injector assembly 10 to be significantly reduced in size. As manufacturing costs drop with increased production volume, single crystal stacks will be the preferred choice for use in the injector assembly 10. In the present embodiment, the injector housing 20 accommodates one 20 mm single crystal stack, one 40 mm standard piezoelectric stack, or two 20 mm single crystal stacks. When the stack design incorporates two 20 mm single crystal stacks, the stacks may be aligned to increase stroke displacement S, or the stacks may be aligned in opposing orientations such that one stack contracts in one direction while the other contracts in another direction. This opposing contraction provided via the use of two stacks, allows one stack to function as a means for providing both initial and real-time adjustment of pre-stress on the primary actuating stack. Consequently, the end cap 50 could be used to establish initial prestress while a second stack could be used to provide a more resolute and fine-tuned control of prestress. Additionally, the second stack could be used to adjust prestress as the housing 20 of the injector 10 expands or contracts due to the housing material's thermal coefficient of expansion. This is beneficial for all engine configurations where thermal expansion is a reality.

In use and operation, compressive prestress forces are placed on the stack 70 to ensure the piezoelectric crystal layers are never placed in tension, where the ceramic piezoelectric material is weaker and the bonds between layers are weaker. In most circumstances, prestress is applied to a piezoelectric stack prior to insertion in a system; however, in this case, the prestress is applied after insertion of the stack 70 in the housing 20. By applying a desired prestress load after the stack 70 is within the housing 20 of the injector 10, differing means may be used to adjust the load on the stack 70 during operation to provide real-time calibration during differing operating scenarios.

Initial desired prestress load is applied to the stack 70 via a screw end cap 50 attached via top threads 26 of the injector housing 20. The end cap 50 can be tightened or loosened to vary the prestress on the stack 70. The ability to adjust and vary the prestress load ensures that there is sufficient downward force on the flow control member 40 to resist opposing opening forces caused by high pressures associated with the combustion cycle and associated fuel supply pressure. In the present embodiment, it was determined that the downward force on the stack 70 required to keep the flow control member 40 closed at 50 bar (6 MPa) is well within the operable stress range of the piezoelectric materials used in the stack 70. Since the stack 70 is initially prestressed and in compression with downward force placed on the flow control member 40 to keep it seated with fuel flow shut off, to operate the injector 10 and lift the flow control member 40 off the sealing seat 38, the stack 70 is powered to contract further, rather than expand. This powering method ensures that the stack 70 is never placed in tension, which would likely damage the stack 70 early in its operational life cycle.

Figure 7A:
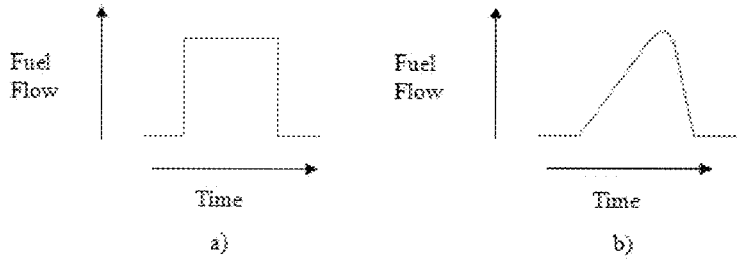
FIG. 7A shows two diagrams representing forms of flow control during a fuel injection cycle wherein diagram a) represents on and off operation of a conventional injector and diagram b) represents the analog and variable control afforded by the injector according to the present invention.

In the present embodiment, the injector 10 accommodates multiple variables associated with control of fuel delivery. As illustrated in FIG. 7A, the injector 10 is designed to support operation in two modes: (a) on/off (open/closed) and (b) analog and variable control of fuel flow rate. In addition, in a first embodiment, the injector 10 limits maximum flow from the injector 10 via inclusion of a flow limiting outlet nozzle 36. In one aspect, the required diameter of the outlet nozzle 36 is sized to satisfy required flow rates for the selected engine system, thereby creating a fixed governing mode. Then, a fundamental minimum size for the injector 10 is selected. The diameter of the outlet nozzle 36 is determined based on fuel supply pressure, desired maximum flow rate, and fuel properties. The thermophysical properties of JP-10 fuel are given in a report by T. J. Bruno et al. Initially, in the present embodiment, the desired fuel flow rate and operating temperature was set at 35 g/s of JP-10 fuel at 300° F. with a minimum operating injection frequency of 100 Hz. In the Bruno report, the sound speed and most other physical quantities are given in the temperature range of 270 K-345 K. At the specified temperature of 300° F. (420 K), most of the physical quantities must be extrapolated. Extrapolating the sound speed curve, the sound speed at 420 K is 975 m/s. For the desired flow requirements, the discharge flow velocity at 200 bars is estimated to be 250 m/s, which is substantially lower than 975 m/s. Consequently, the flow rate of the fuel is in the incompressible range and compressibility effects can be neglected.

For liquid discharge flow through an orifice, the flow rate, q, is given by:

$$q=CA\sqrt{2g144\Delta p/\rho}$$

where q is the volumetric flow rate in $ft^3/s$, C is the dimensionless discharge coefficient (approximately 1, depending on the orifice-to-pipe diameter ratio and the Reynolds number (Re), A is the flow area in ft2, g is a units conversion factor (=32.17 lbm-ft/lbf-s2), Δp is the driving overpressure in psi, and ρ is density in lbm/ft3. Other related units conversion factors are: for density, 1 g/cc=1 kg/m3=62.4 lbm/ft3; for pressure, 1 bar=14.50 psi; for viscosity, 1 mPa-s=10-3 g/s-mm=0.000672 lbm/ft-s; and for mass, 1 lbm=453.515 g.

The extrapolated density of JP-10 fuel at 420° K is 0.85 $kg/m^3$ (53 $lbm/ft^3$). $C_d$=0.98 for Re~$5\times10^4$ which is 0.2% below the asymptotic value of 0.982 for fully turbulent flow. The viscosity extrapolates to 0.68 mPa-s.

Figure 7B:
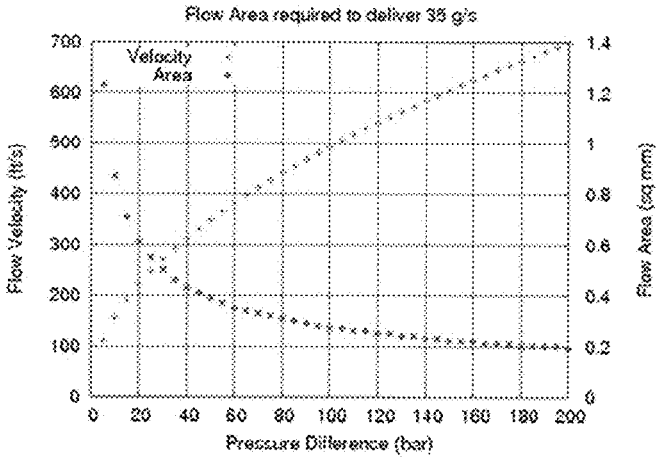
FIG. 7B shows a chart of resulting flow velocity and flow areas as a function of the driving overpressure for the fuel injector nozzle to achieve a flow rate of 35 g/s of JP-10 fuel, according to the present invention.
Figure 7C:
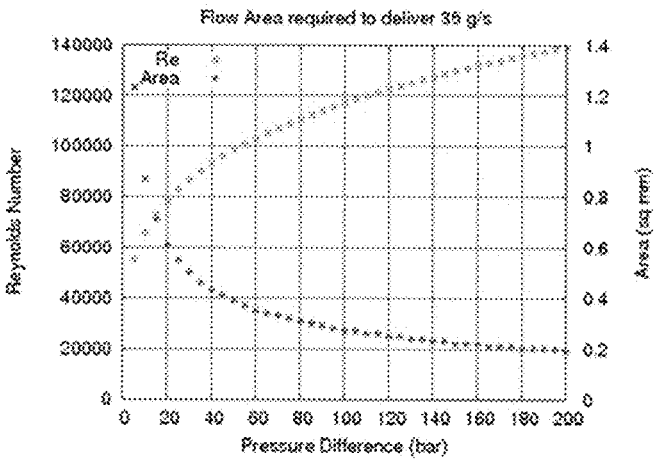
FIG. 7C shows a chart of Reynolds Number and flow areas as a function of the driving overpressure for the fuel injector nozzle to achieve a flow rate of 35 g/s of JP-10 fuel, according to the present invention.

With reference to FIG. 7B, the range of resulting flow velocity and flow areas are given as a function of the driving overpressure. FIG. 7C provides the corresponding Reynolds number. With reference to both FIGS. 7B and 7C, at the required feed pressure of 20 to 50 bar, a flow area of approximately 0.4 to 0.6 sq. mm is required. In the present embodiment, the outlet nozzle 36 having a diameter of 1 mm provides a flow area of 0.78 sq. mm. Consequently, the outlet nozzle 36 will not act as a premature throttle on the desired flow rate but will limit flow at a higher level, acting as a governor to the system.

The disclosed fuel injector 10 will provide opportunities for substantial improvement in many types of combustion engine designs, significantly improving fuel efficiency and reducing emissions. The size of the injector 10 can be scaled down and up to accommodate varied injection requirements. Standard diesel and jet engines stand to benefit greatly from the superior capabilities of this fuel injector technology due to an ability to deliver analog control of flow. In addition, pulse detonation engines, having unique and rigorous operational requirements which heretofore have been previously unmet, now have a greater opportunity to become a legitimate and viable engine modality through the use of the present invention.

Further, the piezoelectric fuel injector 10 of the present invention will serve as foundational and pioneering technology to support substantial redesign of today's combustion engine technologies. An important outcome associated with the use of this electronically-controlled, direct actuation piezoelectric injector configuration is the opportunity to eliminate a plethora of existing engine components including rocker arms, push rods, valve springs, cam shafts, timing belts, and associated equipment. These components would be supplanted by one or more versions of the described piezoelectrically-driven injector assembly 10.

Although the present invention has been described in considerable detail with reference to certain preferred versions thereof, other versions are possible. For example, several versions can be delivered where the inner nozzle surface 34 and the outlet nozzle 36 are removed in their entirety with flow controlled by the annular gap between the nose 48 of the flow control member 40 and the sealing seat 38. Additionally, versions can include multiple stacks which allow further adjustment of the power and displacement of the stack 70 where multiple stacks in parallel increase overall power or force and multiple stacks in series increase overall displacement. Multiple stacks or larger stacks are easily accommodated by increasing either the length or the diameter of the injector housing 20. In addition, versions are possible wherein a second adjustment stack is interposed between the end cap 50 and a first driving stack 70 to provide real-time adjustment of prestress on the driving stack 70. Multiple stacks 70 in parallel relation can be used to adjust alignment of the flow control member 40 within the cylindrical chamber 30 of the housing 20. Additionally, multiple stacks can be used to skew and vibrate the flow control member 40 as a means of mechanically cleaning any scale or deposits which might accumulate during operation and impact the flow profile. Still further, an injector 10 according to the invention hereof can include an operational approach wherein the piezoelectric stack 70 or an ancillary piezoelectric stack is driven at frequencies which would resonate and cause scale and other deposits to be cleaned from the inner cylindrical chamber 30, the inner wall 32, the inner nozzle surface 34, the outlet nozzle 36, and the sealing seat 38. In light of the plurality of versions of the invention described above, the spirit and scope of the appended claims should not be limited to the description of the preferred versions contained herein.

The reader's attention is directed to all papers and documents which are open to public inspection with this specification, and the contents of all such papers and documents are incorporated herein by reference. All the features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "steps for" performing a specific functions, is not to be interpreted as a "means" or "step" clause as specified in 35 U.S.C. Sec. 112, par. 6. In particular, the use of "step of" in the claims herein is not intended to invoke the provisions of 35 U.S.C. Sec. 112, par. 6.

INDUSTRIAL APPLICABILITY

The present invention is applicable to all internal combustion engines using a fuel injection system. This invention is particularly applicable to diesel engines which require accurate fuel injection control by a simple control device to minimize emissions. It is further applicable to advanced engine designs, including gas turbines and pulse detonation engines, where accurate, high frequency control with delivery of fuel at high rates and with a specific profile during each cycle is necessary. In its versions, embodiments, and aspects, the invention is still further applicable to gasoline or ethanol powered combustion engines where it is desirable to replace many moving parts in favor of a simple, electronically-control fuel injection system capable of reducing emissions while improving overall performance. Such internal combustion engines which incorporate a fuel injector in accordance with the present invention can be widely used in all industrial fields, commercial, noncommercial and military applications, including trucks, passenger cars, industrial equipment, stationary power plants, airborne vehicles, rockets, jets, missiles, and others.

We claim:

1. A fuel injector comprising:

(a) an injector housing having a top, a bottom and a body therebetween, said body having a cylindrical chamber therein and a hemispherically-shaped inner nozzle surface, said cylindrical chamber having a sealing seat, said bottom having an outlet nozzle formed therein and extending from said cylindrical chamber to the outside of said bottom, said outlet nozzle providing egress from said cylindrical chamber;

(b) an inlet nozzle attached to said body and providing ingress into said cylindrical chamber;

(c) a flow control member seated within said cylindrical chamber to control flow through said outlet nozzle in conjunction with said sealing seat, said flow control member having a hemispherical nose portion having a first radius of curvature and said hemispherically-shaped inner nozzle surface having a second radius of curvature;

(d) a seal circumscribing said flow control member creating a pressure seal while still allowing said flow control member to move linearly within said cylindrical chamber;

(e) a piezoelectric stack joined to a top of said flow control member such that the motion of said flow control member is driven directly by said piezoelectric stack as said piezoelectric stack expands or contracts to move said flow control member away from or toward said sealing seat and said outlet nozzle; and (f) a control system having a user interface and drive electronics connected to said piezoelectric stack for driving said flow control member to one or more open positions via expansion and contraction of said piezoelectric stack according to the level of applied current and voltage.

2. A fuel injector as recited in claim 1 wherein said seal flexes to accommodate linear motion of said flow control member caused during expansion or contraction of said piezoelectric stack.

3. A fuel injector as recited in claim 1 wherein said injector housing top is defined as being screw-threaded and further comprising an end cap fastened to said injector housing top providing adjustable prestress on said piezoelectric stack.

4. A fuel injector as recited in claim 1 wherein said sealing seat of said cylindrical chamber circumscribes said inner nozzle surface.

5. A fuel injector as recited in claim 1 wherein said flow control member is defined as having a nose having a first radius of curvature and wherein said cylindrical chamber being further defined as having an inner nozzle surface located proximate to said housing bottom and having a second radius of curvature.

6. A fuel injector as recited in claim 5 wherein said second radius of curvature being smaller than said first radius of curvature.

7. A fuel injector as recited in claim 1, in which said drive electronics of said control system comprise a power amplifier, filters, and a processor providing custom design of a driving waveform for controlling linear motion, including both expansion and contraction and multiple combinations thereof, of said piezoelectric stack within said cylindrical chamber throughout each injection and combustion cycle; and a user interface providing user control of said waveform in real time.

8. A fuel injector for injecting fuel into the combustion chamber of an engine comprising:

(a) an injector housing having a hemispherically-shaped inner nozzle surface;

(b) an inlet nozzle attached to said housing for receiving pressurized fuel;

(c) an outlet nozzle positioned at a bottom portion of said injector housing providing an egress into the combustion chamber;

(d) a piezoelectric stack positioned inside said injector housing, said piezoelectric stack having a displacement stroke;

(e) drive electronics connected to said piezoelectric stack providing power to expand and contract said piezoelectric stack throughout its said displacement stroke in real-time;

(f) a flow control member movably positioned within said injector housing, said flow control member having a hemispherically-shaped nose having a first radius of curvature;

(g) said hemispherically-shaped inner nozzle surface located proximate to said bottom portion, said inner nozzle surface having a second radius of curvature; and (h) said flow control member in direct contact with said piezoelectric stack within said injector housing, said piezoelectric stack providing for direct actuation of said flow control member, said flow control member directly moveable by expansion and contraction of said piezoelectric stack between a closed state in which fuel flow from said inlet nozzle through said outlet nozzle into the combustion chamber is blocked and a plurality of intervening open positions wherein fuel may flow through said outlet nozzle at a plurality of differing flow rates according to the size of an annular flow area defined by movement of said flow control member within said injector housing according to expansion and contraction of said piezoelectric stack.

9. A fuel injector as recited in claim 8 wherein a position of said flow control member within said cylindrical housing is variable in direct relationship with expansion and contraction of said piezoelectric stack such that a rate of fuel flow is proportional to the expansion and contraction of said piezoelectric stack.

10. A fuel injector as recited in claim 8 wherein an annular flow area is created between said hemispherically-shaped nose of said flow control member and said hemispherically-shaped inner nozzle surface by the movement of said flow control member wherein said annular flow area is a function of said first radius of curvature, said second radius of curvature and the movement of said flow control member within said cylindrical housing in direct relationship to the expansion and contraction of said piezoelectric stack.

11. A fuel injector as recited in claim 10 wherein a diameter of said flow control member is selected as a function of the available stroke displacement of said piezoelectric stack and directly corresponds to movement of said flow control member within said injector housing to create said annular flow areas required to accommodate preferred fuel flow rates.

12. A fuel injector as recited in claim 8 wherein said movement of said flow control member between a fully open state and a fully closed state is one percent or less of a height of said piezoelectric stack.

13. A fuel injector having a minimal number of components for injecting fuel into a combustion chamber consisting of:

(a) an injector housing having a hemispherically-shaped inner nozzle surface;

(b) an inlet nozzle attached to said injector housing for receiving pressurized fuel;

(c) an outlet nozzle positioned at a bottom portion of said injector housing providing an egress into the combustion chamber;

(d) a piezoelectric stack positioned inside said injector housing, said piezoelectric stack being subjected to a prestress load;

(e) a flow control member movably positioned within said injector housing, said flow control member having a hemispherically-shaped nose having a first radius of curvature;

(f) said hemispherically-shaped inner nozzle surface located proximate to said bottom portion, said inner nozzle surface having a second radius of curvature;

(g) said flow control member directly coupled to said piezoelectric stack within said injector housing, such that said flow control member is directly and variably moveable by said piezoelectric stack between a closed state in which fuel flow from said inlet nozzle through said outlet nozzle is blocked and one or more open state positions in which fuel may flow from said inlet nozzle through said outlet nozzle in relationship to expansion and contraction of said piezoelectric stack; and (h) a control system with drive electronics connected to said piezoelectric stack for powering said piezoelectric stack to directly drive said flow control member via expansion and contraction of said piezoelectric stack throughout a displacement stroke.

14. A fuel injector as recited in claim 13 wherein said fuel injector is made from materials able to withstand combustion operating temperatures and corrosive chemicals, such materials including stainless steel or ceramic.

15. A fuel injector as recited in claim 13 wherein said fuel injector further comprises means for applying said prestress to said piezoelectric stack.

16. A fuel injector as recited in claim 15 wherein said means for applying prestress comprises an end cap wherein said prestress is applied by rotation of said cap sufficiently to apply a prestress load on said piezoelectric stack in accordance with a selected fuel supply pressure.

17. A fuel injector as recited in claim 16 wherein said desired prestress load maintains said piezoelectric stack in compression during operation throughout a combustion/injection cycle.

18. A fuel injector as recited in claim 16 wherein said means for applying prestress by rotation of said end cap includes any of applying rotation to said end cap using geared micrometers or geared stepper motors.

19. A method of operating an injector having a flow control member, said flow control member having a hemispherically-shaped nose having a first radius of curvature, a hemispherically-shaped inner nozzle surface having a second radius of curvature, a sealing seat and a piezoelectric actuator stack that expands and contracts to control linear movement of said flow control member, the method comprising:

applying a prestress load to said piezoelectric actuator stack to ensure said piezoelectric stack remains in compression throughout its operational cycle, applying an initial voltage to said piezoelectric stack to cause said piezoelectric stack to contract and move said flow control member away from said sealing seat of said injector, thereby initiating fuel flow through said injector, temporarily reducing the voltage applied to said piezoelectric stack to adjust for opening forces caused by pressure of the fuel within said injector against said flow control member, subsequently varying the voltage applied to said piezoelectric stack to cause said piezoelectric stack to expand and contract to move said flow control member to one or more intervening positions within said injector thereby establishing corresponding one or more annular flow areas for passage of the fuel through the injector at variable flow rates, adjusting the voltage applied during operation during a combustion cycle to move said flow control member to one or more intervening positions to adjust said annular flow area and vary the fuel flow rate throughout an individual combustion cycle, reducing the applied voltage to cause said piezoelectric stack to expand and move said flow control member toward said sealing seat of said injector, thereby reducing said annular flow area and said fuel flow rate, and where desirable to terminate fuel flow, removing all applied voltage to said piezoelectric actuator stack, causing said piezoelectric stack to expand sufficiently to cause said flow control member to fully engage said sealing seat, thereby cutting off all fuel flow through said injector.

20. The method of claim 19 wherein removing all applied voltage to said piezoelectric stack constitutes a power failure wherein said piezoelectric stack fully expands to its prestressed state in a fail-safe mode terminating all fuel flow through said injector.

* * * * *